United States Patent [19]

Gallo et al.

[11] 4,005,332

[45] Jan. 25, 1977

[54] EFFICIENT DC OPERATED FLUORESCENT LAMPS

[75] Inventors: Charles F. Gallo; Thomas J. Hammond, both of Penfield, N.Y.

[73] Assignee: Xerox Corporation, Stamford, Conn.

[22] Filed: July 14, 1975

[21] Appl. No.: 595,936

[52] U.S. Cl. ..... 315/112; 313/44; 313/174; 315/108

[51] Int. Cl.[2] ..... H01J 61/52; H01J 7/24

[58] Field of Search ..... 315/108, 112, 115, 117, 315/358, 50; 313/11, 44, 174

[56] References Cited

UNITED STATES PATENTS 1,908,648 5/1933 Spaeth ..... 315/108

3,309,565 3/1967 Clark et al. ..... 315/117

*Primary Examiner*—Eugene La Roche

*Attorney, Agent, or Firm*—Robert J. Bird

[57] ABSTRACT

A technique is disclosed herein for the enhancement of efficiency, and uniformity of light emission from a DC-operated fluorescent lamp. It involves the correlation of mercury vapor pressure within the lamp (which is dependent upon the temperature of liquid mercury within the lamp) with the magnitude and polarity orientation of the DC current applied to the lamp, and an optimization of these parameters along with lamp tube diameter.

5 Claims, 5 Drawing Figures

EFFICIENT DC OPERATED FLUORESCENT LAMPS

BACKGROUND OF THE INVENTION

This invention relates to fluorescent lamps of the type in which mercury is the source of primary radiation for phosphor excitation. In such a fluorescent lamp an electrical discharge is generated in mercury vapor at low pressure and typically mixed with argon gas. The light output from the lamp depends, among other variables, on the mercury vapor pressure inside the lamp tube. The primary radiation from the mercury is at 2537 Angstroms and arises from the transition between the lowest non-metastable excited state and the ground state. This ultraviolet radiation at 2537 Angstroms excites a phosphor which is coated inside the tube walls. The excited phosphor thereupon emits radiation at some wavelength, in the visible spectrum, characteristic of the phosphor.

It is known to the prior art that the optimum mercury pressure for maximum light output of a fluorescent lamp in alternating current operation is approximately 7 mtorr, which corresponds to a mercury cold spot temperature of approximately 40° C. Exact values of the optimum vapor pressure and temperature are a function of the lamp tube radius. At cold spot temperatures higher or lower than the optimum light output falls off. The optimum temperature for AC operation is comparatively independent of the current applied to the lamp. That is to say, radiant intensity from an AC fluorescent lamp is at maximum at the approximate 40° C optimum temperature apparently without regard to the applied current. "Cold spot" is used herein to mean that place where the fluorescent lamp tube is coolest and where the mercury is condensed.

SUMMARY OF THE INVENTION

We have discovered that in a fluorescent lamp operated with direct current (as distinguished from alternating current) the behavior is quite different from AC operation. The optimum mercury cold spot temperature is different from that in the alternating current case. Furthermore this optimum temperature is dependent on the orientation of the direct current with respect to the cold spot. A DC lamp with the cold spot at the anode end has an optimum mercury cold spot temperature considerably lower than 40°, and this optimum temperature decreases with increasing current. A DC lamp with the cold spot at the cathode end has an optimum mercury cold spot temperature considerably higher than 40°, and it increases with increasing current.

For a better understandng of this invention, reference is made to the following more detailed description thereof, given in connection with the accompanying drawing.

DRAWING

DESCRIPTION

Figure 1:
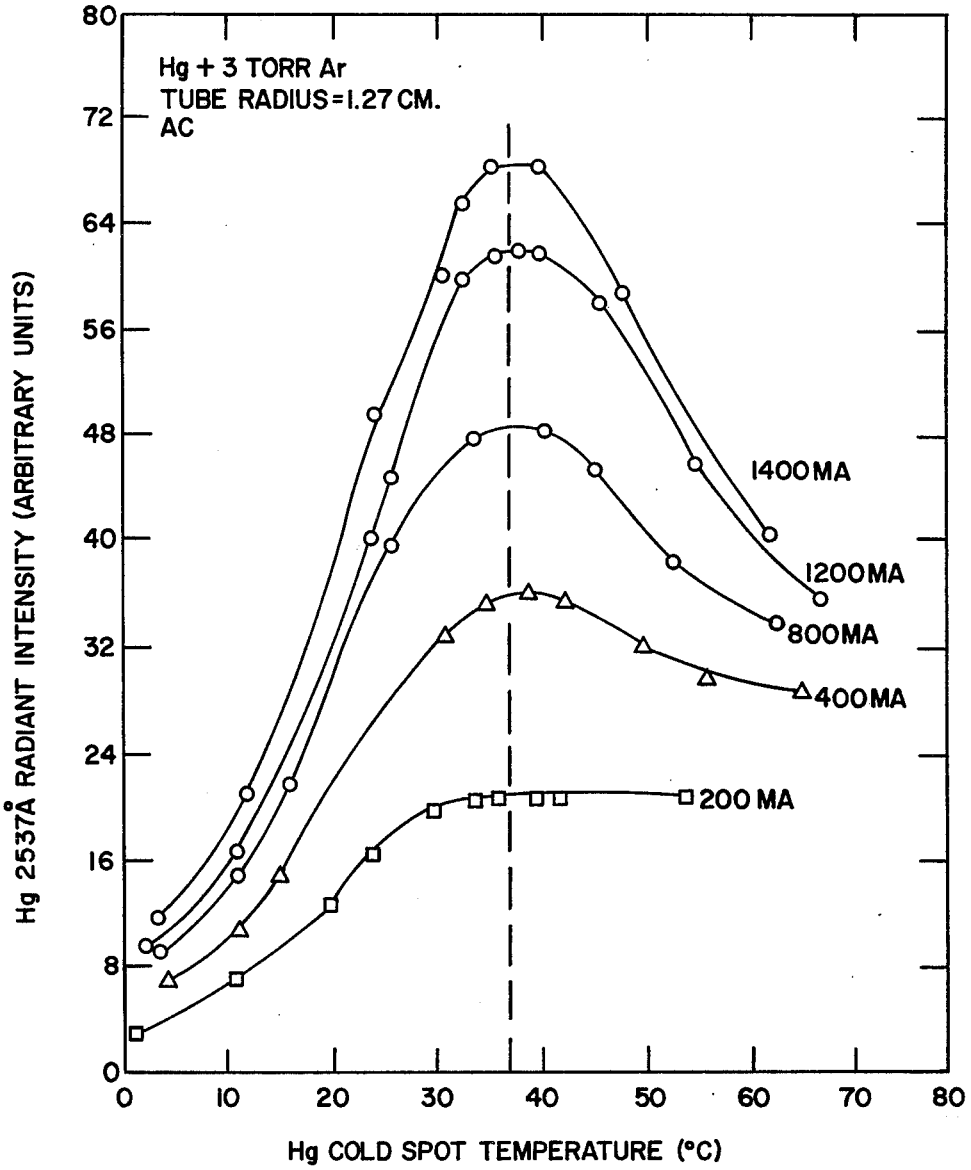
FIG. 1 is a curve of radiant intensity v. mercury cold spot temperature in a 60 cps AC fluorescent lamp at several levels of current.

By way of background, FIG. 1 shows mercury radiation intensity versus mercury cold spot temperature at various levels of 60 cycle AC current in a fluorescent lamp tube of radius 1.2 centimeters and containing argon at 3 Torr pressure. The optimum mercury cold spot temperature is approximately 40° C and this value is comparatively independent of current, especially at the higher currents where the peaks are well defined. This, relating to 60 cycle AC operation, is known to the prior art.

Figure 2:
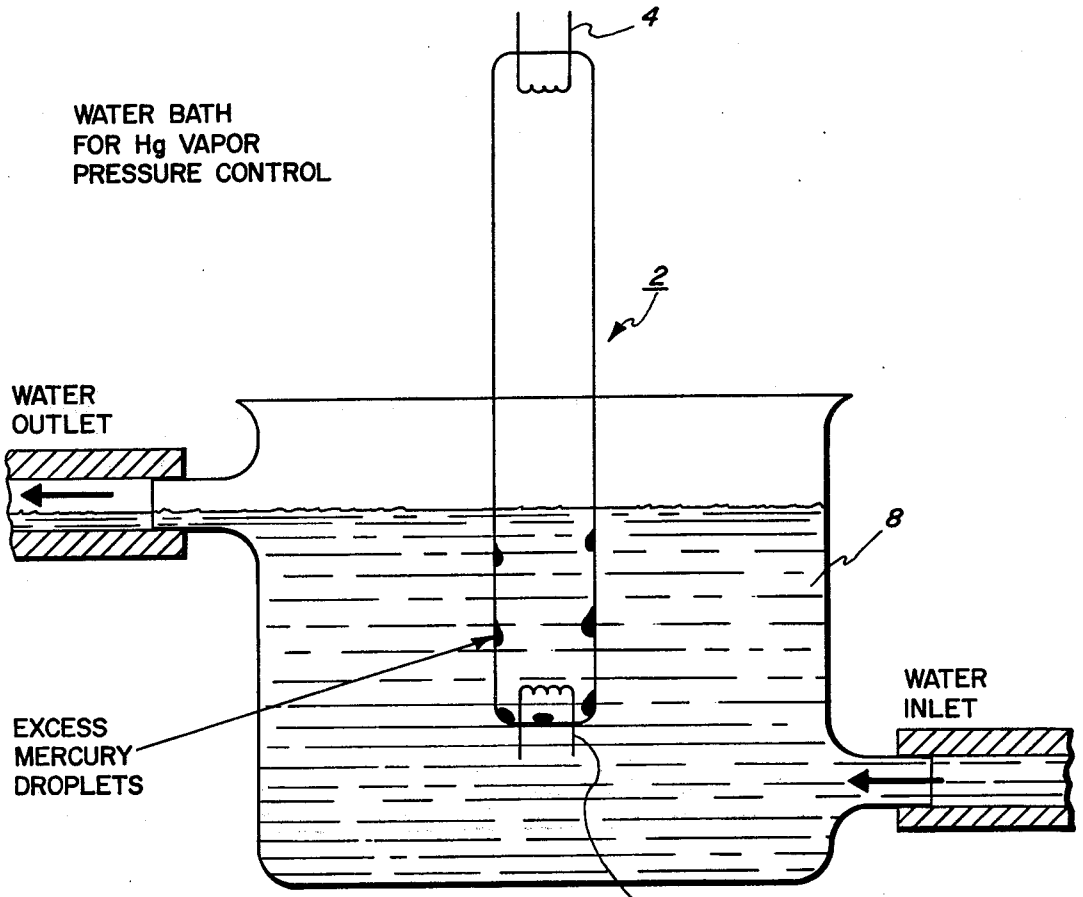
FIG. 2 is a schematic diagram of a fluorescent lamp and associated experimental temperature control bath.

FIG. 2 is a schematic diagram showing DC fluorescent lamp 2 including electrodes 4 and 6 and being operated in conjunction with a water bath 8. Lamp 2 is connected to a source of variable direct current, not shown. The orientation of the lamp 2 is such that condensed or liquid mercury will collect near the electrode 6 at the cooled end of the lamp. The purpose of the cooling arrangement is to create a mercury cold spot and to control its temperature. In our experiments, this controlled temperature was variable from 1° to 70° C. The means to effect the temperature control are shown schematically as a water bath for ease of illustration. While a water bath may be used, and indeed was used in our experiments, a practical commercial implementation of this invention would probably include other forms of temperature controls, such as thermoelectric devices, fans, heat sinks, etc. The particular form of such control is not material here. The lamp 2 contains an excess of mercury so that there is always some liquid mercury in the system.

With a constant direct current flowing through the lamp 2, the controlled ambient temperature of the water bath was changed from 1° to 70° C while the output intensity of the lamp was measured.

Figure 3:
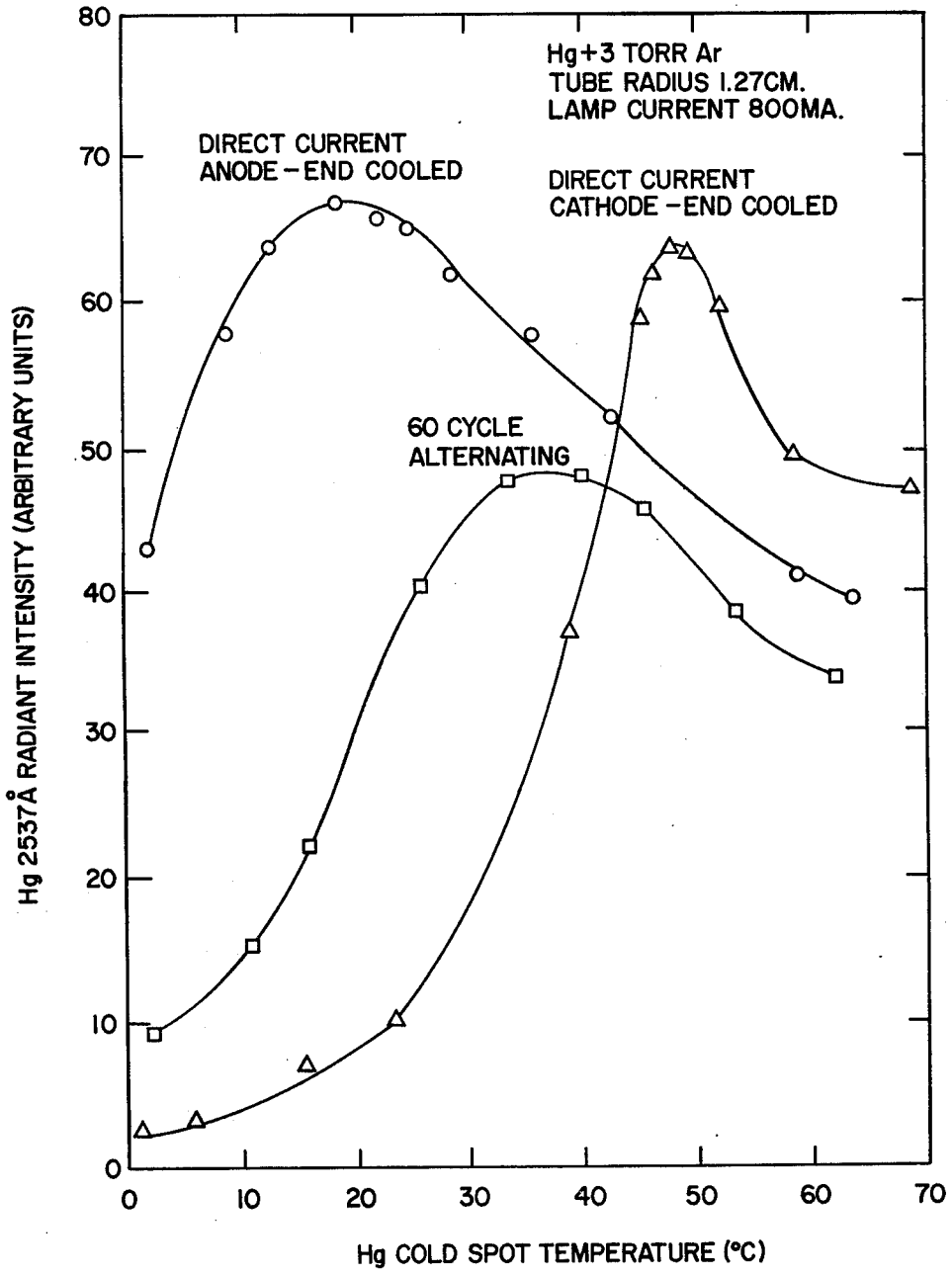
FIG. 3 is a comparison curve of radiant intensity v. mercury cold spot temperature in a fluorescent lamp with three modes of operation.

Referring to FIG. 3, the curve labeled "Direct Current; Anode End Cooled" represents the case in which the lamp was operated with direct current of such polarity that the electrode 6, at the cold spot, is the anode. The curve marked "Direct Current; Cathode End Cooled" represents operation with direct current of reversed polarity such that the electrode 6, at the cold spot, is the cathode. The curve labeled Alternating Current represents 60 cycle alternating current operation described also in connection with FIG. 1 and known to the prior art. FIG. 3 shows in essence that the optimum operating temperature in the case of AC operation is approximately 40° C, that in DC operation with the cold spot at the cathode the optimum is at a higher temperature, and that in DC operation with the cold spot at the anode the optimum is at a lower temperature. Note also that the radiant output is greater for the two modes of DC operation than for 60 cycle AC operation.

Figure 4:
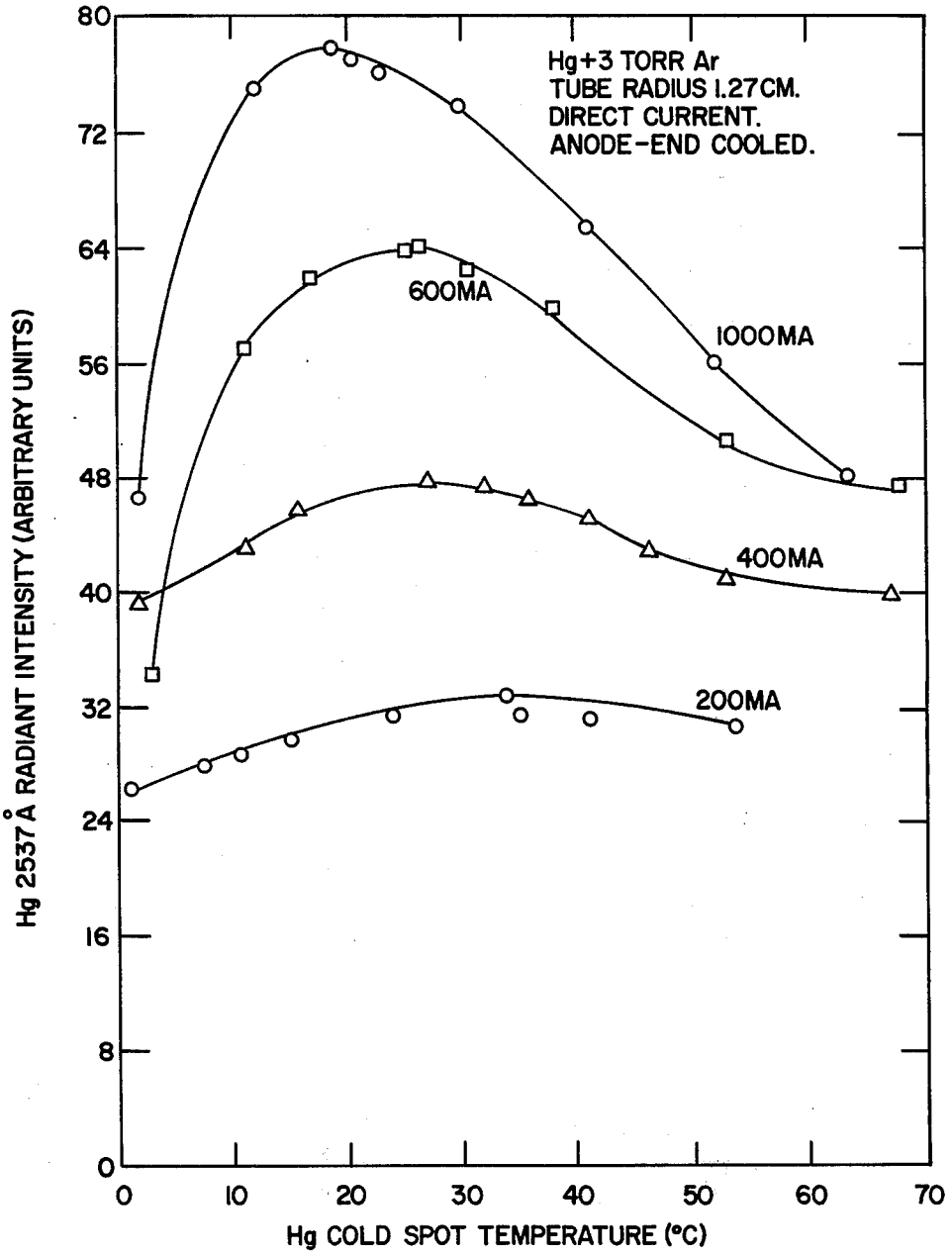
FIG. 4 is a curve similar to FIG. 1 for a DC fluorescent lamp, with a mercury cold spot at its anode end, at several levels of current.
Figure 5:
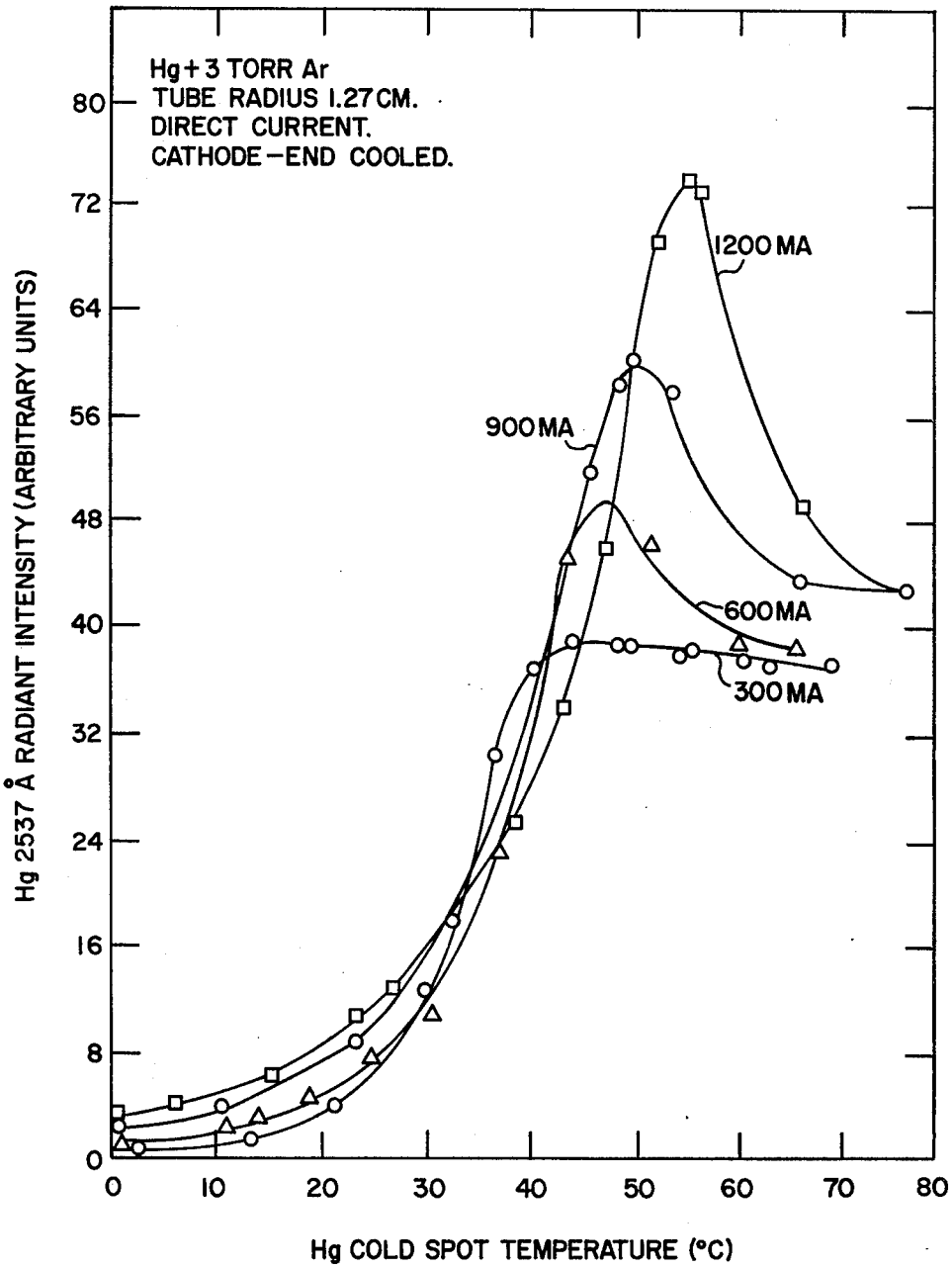
FIG. 5 is a curve similar to FIG. 4 for a DC fluorescent lamp with the cold spot at its cathode end.

Referring to FIGS. 4 and 5, curves similar to FIG. 1 are shown. In FIG. 4, the lamp 2 is operated with DC current with the cold spot at the anode, at four different current levels. FIG. 5 represents similar information for the DC operation of lamp 2 with the cold spot at the cathode. It will be apparent from these curves that, with increasing current, the optimum mercury cold spot temperature decreases in anode-cooled operation, and increases in cathode-cooled operation.

With data such as this, it is possible to select an optimum temperature of operation for a particular lamp operating at a particular current, and thus to maintain its operation at that temperature to maximize its radiant output and/or its peak efficiency.

The experiments represented have been performed on a lamp of 1.27 centimeters radius containing mercury with argon at 3 Torr. The same experiments were run with mercury and argon at 5 Torr in a lamp of 0.79 centimeters radius. These tests produced similar results differing only in particular values but not in their characteristics leading to the same conclusions and offering the same possibilities of operation.

The foregoing material relates to enhancement of intensity of light emission in a DC fluorescent lamp by controlling its vapor pressure, current and the cold spot-electrode orientation. The same parameters can be controlled to enhance (or otherwise control) the uniformity of light emission in a DC fluorescent lamp. Specifically, we have found that the lower the applied current is, the more uniform is the emission from a DC fluorescent lamp. Also, the higher the mercury vapor pressure is within the lamp, the more uniform is its emission. Finally, location of the cold spot near the positive electrode (anode) yields greater uniformity than when near the cathode.

The synergistic combination of the polarity and magnitude of the DC current, cold spot orientation, and tube diameter provide a means to improve the radiant output and efficiency of fluorescent lamps as well as their longitudinal uniformity.

The foregoing description of the method of this invention is given by way of illustration and not of limitation. The concept and scope of the invention are limited only by the following claims and equivalents thereof which may occur to other skilled in the art.

What is claimed is:

1. A method of optimizing the operation of a fluorescent lamp having a pair of electrodes and containing an excess of mercury in a lamp tube at a cold spot therein, to optimize its radiant output, including the steps of:

orienting said lamp and electrodes so that said cold spot is adjacent to one of said electrodes, controlling the temperature at said cold spot to thereby control the pressure of mercury vapor within said lamp tube, applying DC voltage to said lamp between said electrodes to establish a direct current through said lamp, adjustably varying the temperature at said cold spot to achieve maximum output intensity from said lamp at said current.

2. The method as defined in claim 1 wherein said cold spot is located adjacent to the anode of said lamp.

3. The method as defined in claim 1 wherein said cold spot is located adjacent to the cathode of said lamp.

4. A method of achieving uniform light emission from a DC fluorescent lamp having a pair of electrodes and containing an excess of mercury in a lamp tube at a cold spot therein, including the steps of:

orienting said lamp and electrodes so that said cold spot is adjacent to one of said electrodes, controlling the temperature at said cold spot to thereby control the pressure of mercury vapor within said lamp tube, applying DC voltage to said lamp between said electrodes to establish a direct current through said lamp, variably controlling said voltage to thereby control the level of said current, maintaining said temperature at a level to maintain said vapor pressure at an optimum level, maintaining said voltage at a minimum level to maintain current through said lamp, thereby to enhance uniformity of emission from said lamp.

5. The method as defined in claim 4 wherein said cold spot is located adjacent to the anode of said lamp.

* * * * *